United States Patent [19]

Garcin

[11] 4,245,784

[45] Jan. 20, 1981

[54] METHOD AND APPARATUS FOR PROVIDING ELECTROSTATICALLY CHARGED AIRLESS, ROUND SPRAY WITH AUXILIARY GAS VORTEX

[75] Inventor: Félix Garcin, Grenoble, France

[73] Assignee: Air Industrie, Courbevoie, France

[21] Appl. No.: 18,022

[22] Filed: Mar. 6, 1979

[30] Foreign Application Priority Data

Mar. 8, 1978 [FR] France ..... 78 06610
Feb. 15, 1979 [FR] France ..... 79 03875

[51] Int. Cl.[3] ..... B05B 5/02

[52] U.S. Cl. ..... 239/3; 239/708; 239/300

[58] Field of Search ..... 239/3, 690, 696–698, 239/704–708, 290, 291, 300, 404; 361/227, 228

[56] References Cited

U.S. PATENT DOCUMENTS

| | | | |
|---|---|---|---|
| 2,592,297 | 4/1952 | Laguilharre | 239/404 |
| 2,703,260 | 3/1955 | Olson et al. | 239/404 |
| 2,710,773 | 6/1955 | Sedlacsik | 239/707 |
| 3,296,015 | 1/1967 | Juvinall et al. | 239/705 X |
| 3,843,052 | 10/1974 | Cowan | 239/3 |

FOREIGN PATENT DOCUMENTS

| | | | |
|---|---|---|---|
| 1408758 | 7/1965 | France | 239/705 |

*Primary Examiner*—Andres Kashnikow
*Attorney, Agent, or Firm*—Brisebois & Kruger

[57] ABSTRACT

Method and apparatus for providing an electrostatically charged, airless, round vortex spray of liquid in which spray pattern irregularities may be eliminated. In addition to a central nozzle for forming the round vortex spray there is provided an annular nozzle for forming an auxiliary air vortex which is imparted with whirling motion in a direction opposite to that of the round spray of liquid. The air flow rate for the auxiliary air vortex is set above a value at which spray pattern irregularities disappear. The hydrostatic pressure for the round spray ranges between 25 and 75 bars and the air pressure for the auxiliary air vortex ranges between three and one bar.

10 Claims, 7 Drawing Figures

FIG. 5
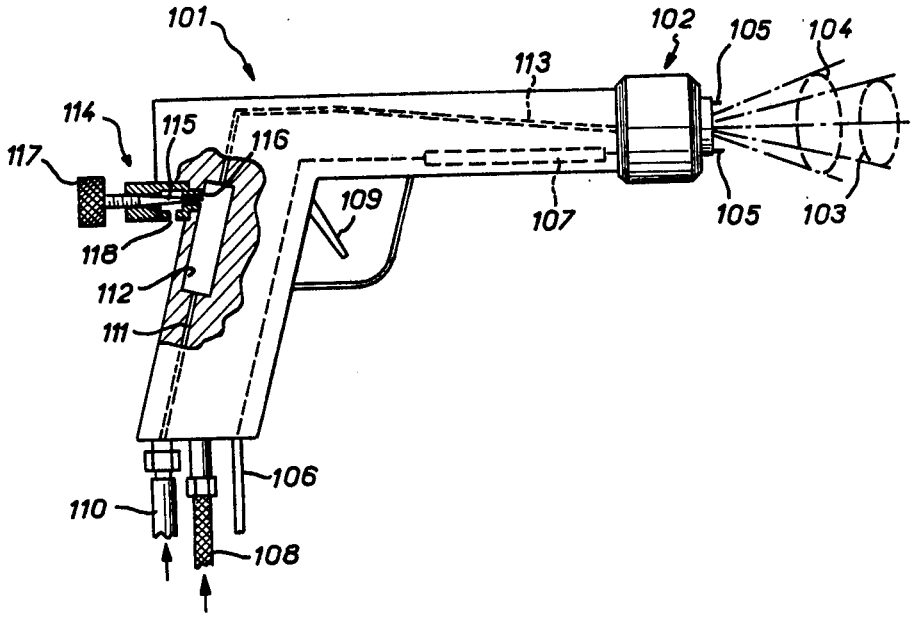
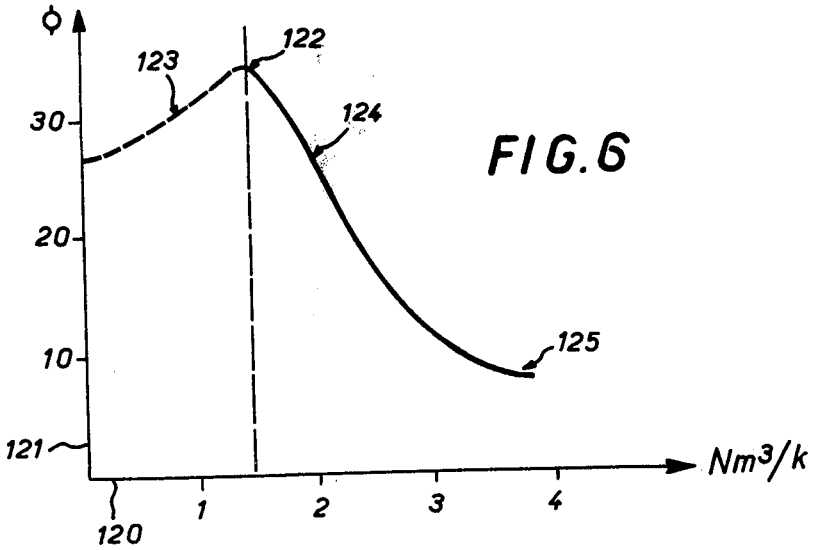
FIG. 6

METHOD AND APPARATUS FOR PROVIDING ELECTROSTATICALLY CHARGED AIRLESS, ROUND SPRAY WITH AUXILIARY GAS VORTEX

The invention relates to an improved method of airless spraying an electrostatically charged liquid into a so-called round or conical spray pattern, and also an electrostatic spray apparatus for performing the method.

Generally speaking, by electrostatically charging a pulverulent substance or liquid projected onto an article to be coated, the uniformity of the coating is improved and the losses due to overspray are reduced. When the substance to be sprayed is a liquid (e.g. paint) the atomization of this liquid is produced by entrainment in a gas propellant (air atomizing spraying) or discharge of the liquid at an elevated pressure through a narrow cross-section nozzle at the outlet of which the liquid dissociates into particles. The latter type of atomization is hydrostatic atomization, better known as airless spraying.

Generally, round sprays or substantially conical configuration around the axis of nozzle are distinguished from flat sprays of diverging fanlike configuration.

It is customary to improve the distribution of the liquid particles in round spray by the "vortex" technique wherein the spray discharged from the nozzle is set into motion by an axial component of velocity as well as by whirling motion around the axis so that every part of the spray in the outlet orifice of the nozzle is subjected to centrifugal force substantially proportional to its distance from the axis of the emerging spray providing a corresponding divergent pattern at the outlet of the nozzle. The whirling motion is generally produced by injecting fluid through tangential channels or passageways into a circular chamber situated immediately upstream of the discharge nozzle relative to the flow therethrough. The vortex technique is expedient both in air atomizing spraying in which case the gas propellant is injected tangentially and airless spraying in which the liquid to be atomized is injected tangentially into the circular chamber.

Airless spraying is often preferred when working at high flow rate ranges because the liquid to be sprayed is not dispersed in a great volume of gas propellant. The liquid flow rate seems to be easier to regulate, either by controlling the flow rate of an injection pump or by controlling the injection pressure whereas with air atomizing spraying the adjustment of the injection pressure of the gas propellant causes the rate of dispersion of the liquid at the same time as the discharge speed of the gas propellant to vary.

Nevertheless experience has shown that with airless spraying the degree of adjustability of the flow rate of a given nozzle is relatively narrow because when the flow rate is reduced (starting with the injection pressure), various irregular spray patterns develop. Generally speaking, the spray pattern irregularities become apparent upon impact against the article to be coated as streaks in the vicinity of the periphery of the central pattern region the shape of which resembles the cross-section of the nozzle. Moreover, airless nozzles are of very small dimensions and, owing to the high injection pressures and speeds, they are fabricated from hard materials which are difficult to machine so that precision sizing of the nozzle orifices is problematic thereby making a wide range of adjustability all the more desirable.

By scrutinizing spray pattern irregularities that are apparent in airless spraying when the injection pressure is reduced and therefore the discharge speed through the nozzle, it has been discovered that the irregularities differ depending on whether a flat fan-shaped spray nozzle is used or a round, vortex spray nozzle. In the case of flat fan-shaped spray nozzles which have markedly elongate outlet orifices the streaks or spots are disposed along the major axis of the roughly elliptical central region. On the other hand with round vortex spray nozzles which produce substantially circular central regions the spray pattern irregularities appear as elliptical streaks or spots uniformly distributed in the proximity of the periphery of the central region with their major axes oriented radially to the axis of the nozzle. It has been also discovered that these streaks or spots are equal in number to the tangential injection passageways or channels opening into the circular chamber upstream of the discharge nozzle relative to the direction of flow therethrough. These irregularities are apparently more related to the configuration of the discharge nozzle, which obviously cannot cause asymmetrical discharge, than the internal structure of the nozzle.

French printed patent specification No. 2,127,874 teaches an arrangement which permits the correction of such spray pattern irregularities in the case of flat fan-shaped airless spraying. This arrangement consists in pointing auxiliary gas streams at the sides of the flat fan-shaped spray of liquid in the vicinity of its zone of formation. Yet the above patent specification only teaches the advantage of pointing auxiliary gas streams at the sides of the fan-shaped spray without specifying the means for carrying it out so as not to enable one skilled in the art to transpose these teachings to other configurations of sprays having spray pattern irregularities of the same origin, let alone to enable one to correct for spray pattern irregularities of ostensibly different origins.

An object of the present invention is the provision of a method of spraying an electrostatically charged liquid wherein the liquid is atomized hydrostatically or airlessly into a round, vortex spray whereby spray pattern irregularities of the liquid under pressure are substantially eliminated.

Another object of the invention is the provision of a method of airless spraying liquid into a round, vortex spray in which the flow rate of liquid to be sprayed is adjustable over a wide range.

According to the invention there is provided a method of spraying electrostatically charged liquid onto an article to be coated comprising the steps of atomizing the liquid under hydrostatic pressure into a vortex spray having not only an axial component of velocity directed at an article to be coated but also whirling component about the axis, electrostatically charging the atomized spray with an axially symmetrical field, characterized by forming an annular coaxial auxiliary gas vortex around the liquid spray, set into whirling motion.

It was unexpected to eliminate the spray pattern irregularities of round vortex spray which appears to result from the internal surface of the spray nozzle by a gas vortex around the round liquid vortex spray therefore beyond the nozzle. It was also unexpected to correct such pattern irregularities with a gas vortex moving along the surface of the film of atomized liquid whereas French printed patent specification No. 2,127,874 taught remedying such pattern irregularities, granted somewhat different, by projecting gas streams against the opposed sides of a flat fan-shaped spray.

It could also not be expected to be able correct such pattern irregularities in view of the teachings of French patent No. 1,408,758 assigned to the assignee of the present application wherein an air-atomized round vortex spray is opened divergently by forming a second coaxial gas vortex, without altering the generally conical shape of the spray. The resultant interaction of two coaxial air vortices may be presumed to be different from the resultant interaction due to a central airless spray and a coaxial auxiliary gas vortex, the first tending to open central vortex and the second eliminates lateral streaking of the central spray pattern.

It has been discovered that it was more effective to correct the spray pattern irregularities when the respective whirling motion of the gas in opposite direction of the liquid spray, that is, one in a right-handed screw (clockwise) direction and the other in a left-handed screw (counterclockwise) direction.

It has also been discovered that the spray pattern irregularities may be remedied with hydrostatic liquid supply pressures ranging from about 25 to 75 bars and auxiliary vortex gas pressures ranging between about three and one bar.

According to the teachings of French patent No. 1,408,758 it might have been expected that the auxiliary air vortex would cause some divergence of the airless, round spray pattern. Yet the possibilities of adjusting the opening of the atomized round spray appeared restricted owing to the existence of a minimum flow rate or drive pressure for the auxiliary gas vortex required to eliminate spray pattern irregularities. It has also been discovered that by gradually increasing the drive pressure and accordingly the flow rate of the airless, round spray, the airless, round spray at first did in fact flare whereas the spray pattern irregularities were eliminated, yet above a threshold or critical flow rate of the auxiliary vortex gas the increase in the flow rate caused, on the contrary, a reduction in the flare of the atomized round spray. Thus by adjusting the flow rate of the gas vortex above the minimum value at which spray pattern irregularities disappear the opening of the atomized round spray could be adjusted over wide ranges.

According to another aspect of the invention there is provided apparatus for spraying electrostatically charged liquid for performing the method defined above, comprising a central nozzle adapted to be supplied with pressurized liquid and adapted to impart an axial component of velocity to this liquid as well as moment of rotation or whirling motion, and a set of charging electrodes spaced around the central round spray nozzle, characterized by the apparatus comprising an annular auxiliary gas vortex nozzle coaxial to the central nozzle adapted to be connected to a source of pressurized gas and adapted to discharge the gas to impart an axial component of velocity as well as a whirling motion.

To conveniently adjust the drive pressure and the flow rate of the annular gas vortex nozzle the communication between the last mentioned nozzle and the source of pressurized gas comprises a chamber with adjustable bleed means communicating with the atmosphere.

These and other features and advantages of the invention will become apparent in the description which follows, given by way of example, with reference to the accompanying drawings, in which.

FIG. 5 diagrammatically represents an apparatus embodying the invention equipped with means for adjusting the opening of the round spray pattern of liquid under hydrostatic pressure; and FIG. 6 shows a graph of an opening of the airless, round spray pattern plotted against the flow rate of air for the auxiliary air vortex.

Figure 1:
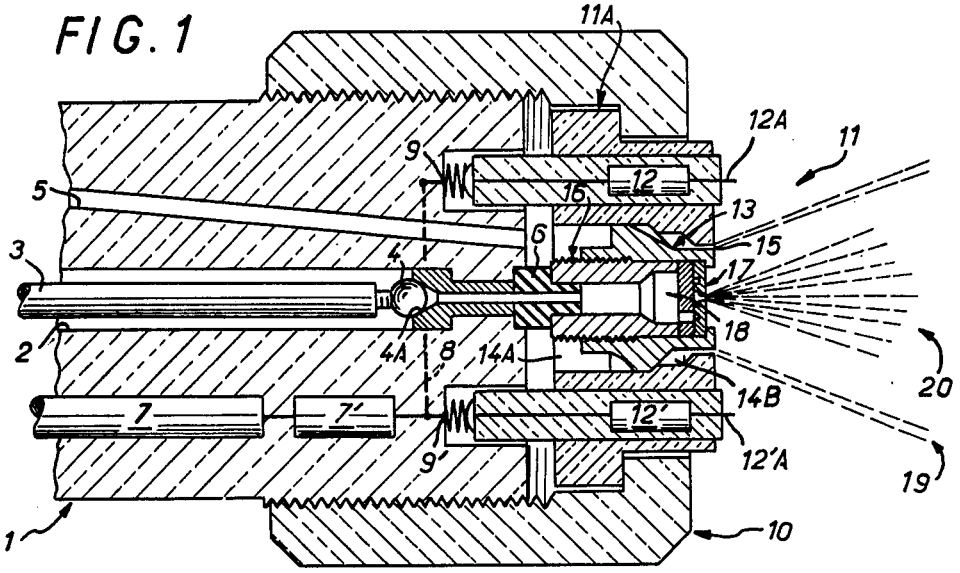
FIG. 1 shows the front part of an electrostatic spray apparatus embodying the present invention.

According to the preferred illustrated embodiment of FIG. 1 the electrostatic spray apparatus includes a spray gun comprising a body 1 of insulating material in which are provided fluid supply lines and high voltage lines which are typically connected by a pistol grip or mount to a support, not shown. The fluid supply lines comprise a central conduit 2 which is supplied with liquid to be atomized and projected, such as paint. In conduit 2 is mounted a needle valve stem 3 with a ball valve member 4 at its forward end cooperable with a valve seat 4A. As is customary the operation of the spray gun is triggered by retracting the needle valve stem 3 which causes the ball valve member 4 to move out of sealing contact with valve seat 4A. An inclined channel 5 which opens on the forward face of the body 1 carries the supply of pressurized gas. A series of resistors 7 and 7' acting as a current-limiting device serve as a high voltage supply line for electrostatically charging atomized liquid. The series of resistors 7 and 7' are connected to connector terminals 9 and 9' via connector conductor 8, the connector terminals 9 and 9' being located on the endwall of recesses formed in the forward face of the body 1.

A union nut 10 screwed on the body 1 holds the spray head assembly 11 as a unit in front of the forward face of the body 1. The spray head assembly 11 comprises a stepped ring 11A of insulating material housing resistors 12 and 12' embedded in insulating cylinders. The rear ends of the resistors 12 and 12' provided with contact studs are accommodated in recesses for terminals 9 and 9', the contact studs bearing against contact springs connected to the terminals 9 and 9'. The forward ends 12A and 12'A of resistors 12 and 12' comprise wire leads which protrude beyond the front end of the ring 11A.

Figure 2B:
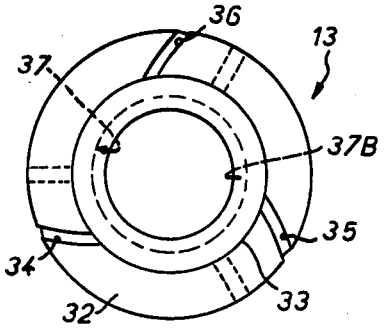
FIGS. 2A and 2B show a side elevational view partly cut away and an end view of a deflector for an auxiliary air vortex nozzle.
Figure 2A:
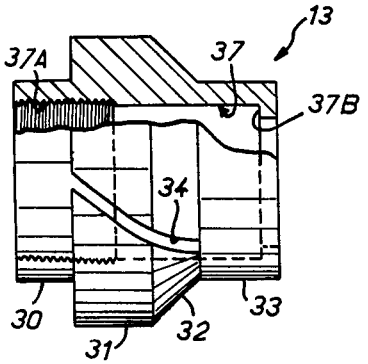

The inner surface of the stepped ring 11A is composed of three cylindrical portions of decreasing diameter from back to front, connected by two frustoconical portions. Inside the stepped ring 11A for the spray head assembly 11 is received a deflector ring 13 of generally tubular configuration with a cylindrical frustoconical protrusion midway along its length. As best seen in FIGS. 2A and 2B the protrusion between the rear cylindrical portion 30 and the forward cylindrical 33 comprises a cylindrical portion 31 which is received in the large diameter recess in the stepped ring 11A and a frustoconical portion 32 which abuts against the first frustoconical connecting zone in the stepped ring 11A. Three right-handed helical grooves 34, 35 and 36 are machined in the cylindrical-frustoconical portions 31 and 32. The deflector ring 13 inside the stepped ring 11A defines a first rear, annular chamber 14A, a second annular chamber 14B communicating through helical channels 34, 35 and 36 with the chamber 14A and an annular nozzle between the forward cylindrical portion 33 of the deflector ring 13 and the forward cylindrical portion of the recess in the stepped ring 11A.

The deflector 13 comprises a cylindrical wall 37 (see FIG. 2) tapped at its rear end 37A and terminating at its front end by an annular shoulder 37B. In the cylindrical space defined by cylindrical wall 37 is housed a tubular sleeve 16 the forward end of which clamps a round spray nozzle 17 against the shoulder 37B of the deflector ring 13.

Figure 3:
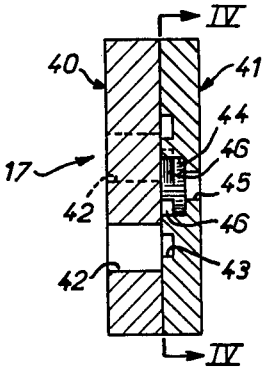
FIG. 3 shows a sectional view of an airless, round spray atomizing nozzle.
Figure 4:
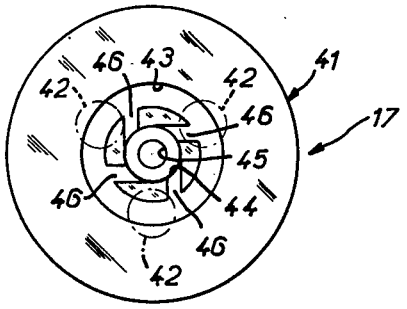
FIG. 4 shows a sectional view taken on line IV—IV in FIG. 3.

The structure of the nozzle 17, known per se, is best viewed in FIGS. 3 and 4. The nozzle 17 is comprised of two flat circular parts, that is, a back plate 40 and cover plate 41. There are three ports 42 in the back plate 40 spaced 120° from each other along a circle concentric with the spray gun axis. The cover plate 41 comprises an annular groove 43 and a circular central chamber 44 coaxial to each other. The chamber 44 opens on the front face of the cover plate 41 through a discharge orifice 45 of diameter smaller than the chamber 44. Four passageways 46 open tangentially into the chamber 44 between the groove 43 and the chamber 44, these passageways being directed counterclockwise when viewed from the rear.

The operation of the apparatus will now be described. The pressurized liquid to be sprayed enters the central conduit 2. By retracting the needle valve stem 3, ball valve member 4 moves away from valve seat 4A thereby permitting the liquid to enter chamber 18. The pressurized liquid then traverses the back plate 40 of the nozzle 17 via ports 42, enters the groove 43 and on to the chamber 44 via tangential passageways 46. The tangential injection of liquid imparts thereon a moment of rotation or whirling motion about the axis of the chamber which coincides with the axis of the spray gun generally. The liquid is discharged from the discharge orifice 45 along the axis and, owing to the whirling motion imparted in the chamber 44, emerges as a so-called "round", vortex spray pattern 20 and breaks up into fine droplets.

The wire electrodes 12A and 12'A connected at high voltage through limit resistors 7 and 7' apply electric charges to the sprayed liquid particles in the conventional manner so that the electric field prevailing between the electrodes 12A and 12'A and the article to be coated guides the charged droplets towards the article.

In the foregoing respects the present apparatus does not differ in operation from an electrostatic, airless, round spray gun. It should, however, be noted that the resistors 12 and 12' supplied through terminals 9 and 9' by the same high voltage source ensure an equalization of the charging currents discharged by the electrodes 12A and 12'A and thereby a uniform charging of the round spray pattern 20.

When the inlet pressure of the liquid in conduit 3 is reduced to lower the flow rate, spray pattern irregularities appear which manifest themselves upon impact against the article being sprayed as detached streaks or spots in the vicinity of the substantially circular central region. With a nozzle of the nozzle 17' type comprising four injection passageways 46 four detached streaks or spots are produced at right angles from one another. With a three injection passageways three detached spots are produced at 120° from one another.

In order to suppress or eliminate the detached streaks or spots compressed air is supplied into the inclined channel 5. The air enters the space between the forward end of the body 1 and the rear end of the spray head assembly 11, then into the rear annular chamber 14A and through the helical channels 34, 35, 36 in the deflector ring 13 where a moment of rotation is imparted, and it is injected in whirling motion into annular chamber 14B from which it is expelled through annular outlet orifice 15 as an auxiliary air vortex 19 surrounding the liquid spray pattern 20.

In the course of the first tests performed it was established that with a nozzle 17 providing a left-handed liquid vortex using a deflector ring 13 with right-handed passages 34, 35, 36 thereby imparting right-handed screw motion to the air vortex, the detached streaks or spots were eliminated with a little lower compressed air pressure.

Eventually the following results were obtained with an airless, round spray nozzle for pressures less than 80 bars.

At a supply pressure of 35 bars the detached streaks or spots disappeared with a compressed air at a pressure of 1.5 bar. Still, when a thick coat of paint was deposited there were bubbles which were eliminated by increasing the air supply pressures for the auxiliary air vortex to 2.4 bars. With hydrostatic paint supply pressures of 60 bars a very good deposition was achieved without detached spots, or bubbles, with compressed air for the auxiliary air vortex at 1.5 bar.

FIG. 5 illustrates a spray gun 101 comprising a barrel or front end 102 constructed in accordance with FIGS. 1–4 and producing a round, vortex spray pattern 103 surrounded by an auxiliary air vortex 104. The electrodes 105 produce an electrostatic charging field for the liquid droplets and are supplied with high voltage by a cable 106 through current-limiting resistor 107 comparable to the resistors 7 and 7' of FIG. 1. The liquid to be sprayed, such as paint, is conveyed at elevated hydrostatic pressure through a hose 108; the trigger 109 controls the entry of liquid into the central nozzle by retracting the needle valve stem (not shown here for the sake of clarity) identical to the arrangement in FIG. 1.

The compressed air for the auxiliary air vortex 104 enters the spray gun 101 through a compressed air hose 110 which communicates with a bore 111 of small cross-section up to the chamber 112. From the chamber 112 the compressed air flows through conduit 113 to the annular nozzle which forms an auxiliary air vortex 104.

Chamber 112 is fitted with a bleed valve 114 comprising a needle valve member 115 which to a greater or lesser degree closes valve seat 116 depending on the position of set screw 117. The air which is bled off between the needle valve member 115 and its valve seat 116 escapes to the atmosphere through a vent 118.

In order to determine the adjustment range for the opening of the round spray pattern by adjusting the air flow rate of the auxiliary air vortex and therefore to determine the dimensions of the flow passages through the adjustment assembly, experiments were performed under the following laboratory conditions:

EXPERIMENTAL CONDITIONS

Airless, round spray nozzle:
- diameter 0.5 mm;
- three supply passageways 0.2 mm×0.2 mm in section and 1.5 mm long;

Paint sprayed: viscosity 25 seconds with an AFNOR No. 4 cup, resistivity 400 megohm-cm;
Supply voltage: 60 kV;
Auxiliary air vortex nozzle: 70° slope of passageways relative to axis;
Distance from spray nozzle to target: 20 cm.

The air pressure of compressed air supplied to the annular auxiliary air vortex nozzle was varied to provide air flow rates expressed in cubic meters per hour at standard conditions from zero $m^3/h$. The results are recorded in the following table:

| Air Flow Rates ($m^3/h$) | Diameter of Paint Pattern at Impact on Target (cm) |
|---|---|
| 0 | 27 |
| 0.9 | 32 |
| 1.4 | 37 |
| 1.8 | 30 |
| 2.1 | 25 |
| 2.4 | 18 |
| 3.0 | 11 |
| 3.4 | 9 |

In the graph of FIG. 6 are shown the results of the above table with air flow rates plotted on the X axis and the round spray pattern diameter at impact, on the Y axis 121. The pattern diameters increase proportionally with air flow rates up to 122 $m^3/h$ as shown by dashed line 123 then decrease asymptotically as shown by solid line 124 to minimum of 125 $m^3/h$. It will be noted that the dashed line 123 has a range of about 1.4/1 whereas the solid line 124 has a range of about $\frac{1}{4}$. This, in conjunction with the fact that for low air flow rates or pressure, spray pattern irregularities are present shows that it is particularly advantageous to operate in the solid line region to vary the opening of the liquid spray pattern which corresponds to the liquid spray pattern diameter.

Coming back to the spray gun illustrated in FIG. 5, it is plain for one skilled in the art that for reducing the air flow rate in the annular auxiliary air vortex nozzle forming the auxiliary air vortex 104 by controlled variations of the bleed valve 114 emanating from a source of compressed air at constant pressure, the fluid flow efficiency of the passage 111 must be limited so that the pressure in the chamber 112 varies in accordance with the bleed rate. A satisfactory compromise between a wide range of flow rates, which means that the fluid flow efficiency of the passage 111 should not be too high and cost considerations which means that the loss of head in passage 111 should not be too high and therefore the fluid flow efficiency is not too low, involves selecting the fluid flow efficiency of the passage 111 material between 5 and 10 times greater than the fluid flow efficiency of the annular auxiliary air vortex nozzle. The term "fluid flow efficiency of the nozzle" means the fluid flow efficiency of the nozzle including that of the supply channels including conduit 113.

With this value of fluid flow efficiency of the bore 111 for providing a variation of the flow rate through the auxiliary air nozzle corresponding to solid line portion of the curve of the graph of FIG. 6 it is appropriate for the fluid flow efficiency of the bleed valve 114 when the needle valve member 115 is in its fully retracted position to be between 10 and 20 times the fluid flow efficiency of the annular auxiliary air vortex nozzle.

Of course the invention is not limited to the described and illustrated embodiments but it is to be understood that all modifications, alternatives and equivalents may be resorted to without departing from the scope of the appended claims.

What I claim is:

1. A method of spraying electrostatically charged liquid for coating an article, comprising airlessly atomizing liquid to be sprayed under hydrostatic pressure into a round spray imparted with both an axial component of velocity and whirling motion, charging the atomized spray in an axially symmetrical electrostatic field, the improvement comprising the steps of forming around the round spray a coaxial annular auxiliary gas vortex imparted with whirling motion, and maintaining the gas flow rate for supplying the auxiliary gas vortex at or above a value at which spray pattern irregularities disappear.

2. A method according to claim 1, wherein the whirling motion of the round spray of liquid and that of the auxiliary gas vortex are in opposite directions of rotation.

3. A method according to claim 1 or 2, comprising supplying liquid for the round spray at a hydrostatic pressure ranging between about 25 and 75 bars, and supplying gas for the auxiliary gas vortex at a pressure ranging between about three and one bar.

4. A method according to claim 1, further comprising adjusting the gas flow rate for the auxiliary gas vortex so as to vary the opening of the round spray pattern.

5. Electrostatic, airless, round-spray apparatus, comprising a central airless atomizing nozzle adapted to be supplied with liquid under hydrostatic pressure, said central nozzle being constructed to define a round, vortex spray with both an axial component of velocity and whirling motion around the axis, and a plurality of charging electrodes spaced around the central nozzle, the improvement comprising an auxiliary gas vortex nozzle coaxial to and disposed radially outwardly of said central nozzle and adapted to be connected to a source of pressurized gas, said auxiliary gas vortex nozzle being constructed to define a gas vortex with an axial component of velocity and whirling motion about the axis.

6. Electrostatic, airless, round-spray apparatus, comprising a central airless atomizing nozzle adapted to be supplied with liquid under hydrostatic pressure, said central nozzle being constructed to define a round, vortex spray with both an axial component of velocity and whirling motion around the axis, a plurality of charging electrodes spaced around the central nozzle, an auxiliary gas vortex nozzle coaxial to and disposed radially outwardly of said central nozzle and adapted to be connected to a source of pressurized gas, said auxiliary gas vortex nozzle being constructed to define a gas vortex with an axial component of velocity and whirling motion about the axis, the charging electrodes having protruding wire ends disposed substantially parallel to the axis and lying along a circle concentric to said central nozzle, and further comprising at least one resistor adapted to connect said electrodes to a single high voltage source, each said electrode being associated with an equalizing resistor serially connected in the immediate proximity of its protruding end.

7. Electrostatic, airless, round-spray apparatus, comprising a central airless atomizing nozzle adapted to be supplied with liquid under hydrostatic pressure, said central nozzle being constructed to define a round, vortex spray with both an axial component of velocity and whirling motion around the axis, a plurality of charging electrodes spaced around the central nozzle, and an auxiliary gas vortex nozzle coaxial to and disposed radially outwardly of said central nozzle and adapted to be connected to a source of pressurized gas, said auxiliary gas vortex nozzle being constructed to define a gas vortex with an axial component of velocity and whirling motion about the axis, and wherein said auxiliary gas vortex nozzle is adapted to be connected to a source of pressurized gas via a conduit comprising a chamber provided with adjustable bleed means for bleeding auxiliary gas to the atmosphere.

8. Apparatus according to claim 7, wherein said apparatus comprises a spray gun, said chamber being incorporated in said spray gun.

9. Apparatus according to claim 7 or 8, wherein said conduit comprises upstream of said chamber a bore of narrow cross-section the fluid flow efficiency of which is five to ten times the fluid flow efficiency of said auxiliary gas vortex nozzle.

10. Apparatus according to claim 9, wherein said bleed means has a maximum fluid flow efficiency between about 10 and 20 times the fluid flow efficiency of said auxiliary gas vortex nozzle.

* * * * *